US008280063B2

(12) United States Patent
Schmidt

(10) Patent No.: US 8,280,063 B2
(45) Date of Patent: Oct. 2, 2012

(54) LOUDSPEAKER PANEL WITH A MICROPHONE AND METHOD FOR USING BOTH

(75) Inventor: Juergen Schmidt, Wunstorf/Luthe (DE)

(73) Assignee: Thomson Licensing, Issy-les-Moulineaux (FR)

( * ) Notice: Subject to any disclaimer, the term of this patent is extended or adjusted under 35 U.S.C. 154(b) by 690 days.

(21) Appl. No.: 12/383,563

(22) Filed: Mar. 25, 2009

(65) Prior Publication Data

US 2009/0245545 A1 Oct. 1, 2009

(30) Foreign Application Priority Data

Mar. 28, 2008 (EP) ..... 08103060

(51) Int. Cl.
*H04R 29/00* (2006.01)

(52) U.S. Cl. ..... 381/59; 381/57; 381/94.1; 381/182

(58) Field of Classification Search ..... 381/57, 381/59, 182, 94.1, 94.2, 94.4, 94.7, 96
See application file for complete search history.

(56) References Cited

U.S. PATENT DOCUMENTS 5,559,893 A * 9/1996 Krokstad et al. ..... 381/71.7
5,748,749 A * 5/1998 Miller et al. ..... 381/71.5
2001/0035150 A1* 11/2001 Daly et al. ..... 123/198 E
2005/0063552 A1 3/2005 Shuttleworth et al.
2006/0034469 A1* 2/2006 Tamiya et al. ..... 381/97
2006/0159289 A1* 7/2006 Stiles et al. ..... 381/111

FOREIGN PATENT DOCUMENTS

DE 10332611 A1 * 2/2005
DE 10 2005 019 604 A1 9/2006
WO WO 01/67808 A1 9/2001
WO WO 2007/052374 5/2007

OTHER PUBLICATIONS

English machine translation of DE 10 2005 019 604.*
European Search Report dated Aug. 14, 2008.

* cited by examiner

*Primary Examiner* — Tom Thomas
*Assistant Examiner* — Christopher M Roland
(74) *Attorney, Agent, or Firm* — Myers Wolin, LLC

(57) ABSTRACT

In public audio presentation it is desirable that the playback loudness is continuously adapted to the background noise loudness. Such adaptation of the playback volume requires a continuous measurement of the loudness somewhere within the sound exposure area. A dipole loudspeaker panel has a strong attenuation of the emitted sound in the panel plane. When placing a microphone capsule in that plane but outside the panel, the sound emitted from the panel will be recorded by the microphone with a significant sound pressure level attenuation. Such specific microphone arrangement can capture the background noise without being unduly disturbed by the direct sound emitted from the loudspeakers.

10 Claims, 7 Drawing Sheets

LOUDSPEAKER PANEL WITH A MICROPHONE AND METHOD FOR USING BOTH

FIELD OF THE INVENTION

This application claims the benefit, under 35 U.S.C. §119 of European Patent Application 08103060.3, filed Mar. 28, 2008.

The invention relates to a loudspeaker panel with a microphone and to method for using the loudspeaker panel and the microphone for directional audio presentation.

BACKGROUND OF THE INVENTION

In public audio presentation, e.g. an acoustic advertisement in a supermarket, it is desirable that the playback loudness is continuously adapted to the background (noise) loudness. Such adaptation of the playback volume requires a continuous measurement of the loudness somewhere within the sound exposure area, whereby the measured signal is a summation of the source signal convolved with the transfer function of the loudspeaker, the source signal convolved with the room impulse response, and the background noise, as depicted in FIG. 1. To achieve a correct estimation of the background noise, signal processing is required, e.g. echo cancellation technology with respect to the source signal.

In particular, achieving a comfortable playback volume in public presentation requires the measurement of the background noise and the measurement of the presentation set (i.e. loudspeaker) loudness, i.e. the 'own' loudness.

SUMMARY OF THE INVENTION

However, echo cancellation technology requires lots of processing power and a robust processing.

A problem to be solved by the invention is to capture such noise level for measurement, in connection with using directional loudspeakers, but thereby reducing the efforts.

By corresponding measurements it was found that a dipole loudspeaker panel has a strong attenuation of the emitted sound in the panel plane. When placing a microphone capsule in that plane but outside the panel, the sound emitted from the panel will be recorded by the microphone with a significant sound pressure level attenuation, e.g. more than 30 dB. This attenuation is frequency dependent due to e.g. diffraction effects at the panel side and reflections at the loudspeaker basket. Such specific microphone arrangement can capture the background noise without being unduly disturbed by the direct sound emitted from the loudspeakers.

In principle the inventive loudspeaker panel has a common housing including several loudspeakers arranged in a plane such that the loudspeaker panel forms a dipole having a directional sound pressure characteristic, wherein the axis of symmetry of each loudspeaker is arranged in z-direction perpendicular to said plane and wherein to said housing a microphone is attached outside said housing, for example with a distance of 1-2 cm, and basically in said plane but optionally shifted in said z-direction.

The microphone can be shifted in z-direction such that it receives a minimum sound pressure level from the direct sound emitted from said loudspeakers.

In principle, the inventive method is suited for using said loudspeaker panel for audio presentation, said method including the steps:

capturing background noise with said microphone;

capturing the loudspeaker signal with said microphone;

using the microphone output signal for controlling the sound pressure level output from said loudspeakers.

BRIEF DESCRIPTION OF THE DRAWINGS

Exemplary embodiments of the invention are described with reference to the accompanying drawings, which show in.

DETAILED DESCRIPTION OF PREFERRED EMBODIMENTS

The directional behavior of a dipole loudspeaker panel can be used to focus the sound on a small area, without disturbing neighbor regions.

Figure 1:
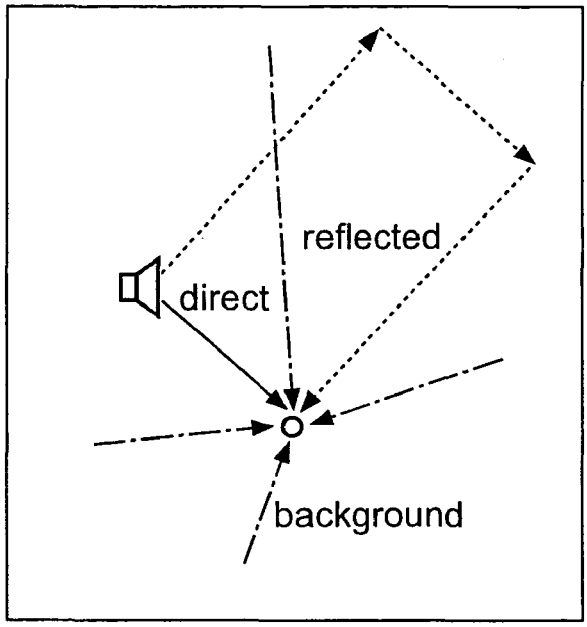
FIG. 1 a loudspeaker (dipole) arranged in a room with background noise.
Figure 2:
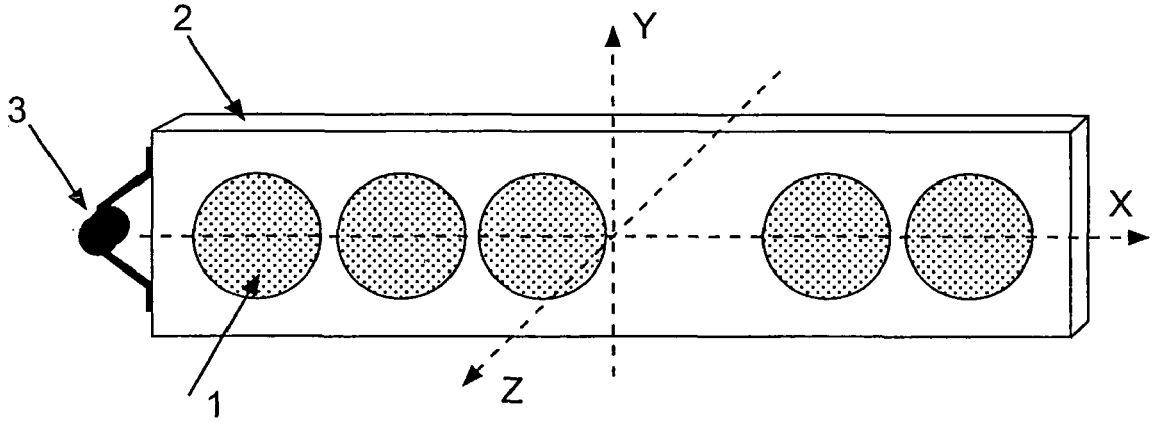
FIG. 2 inventive microphone placement for a 6-loudspeaker dipole panel.
Figure 3:
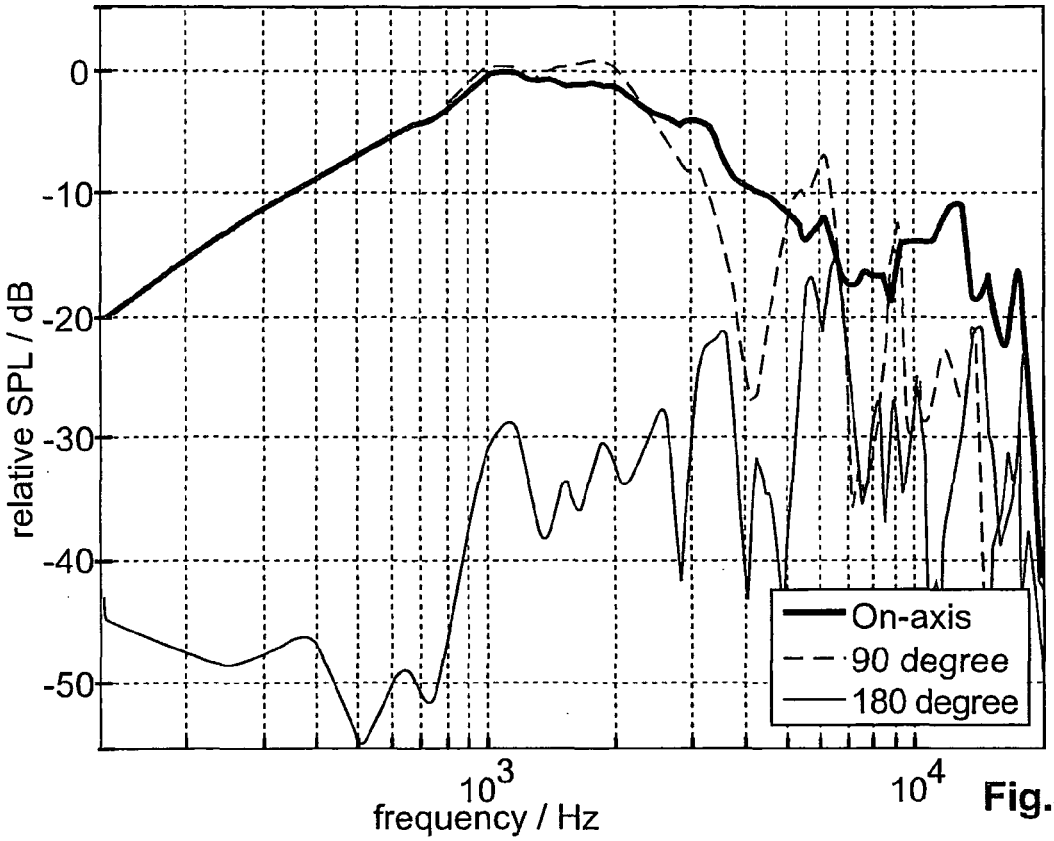
FIG. 3 uncompensated frequency response of the 6-loudspeaker dipole panel.
Figure 5:
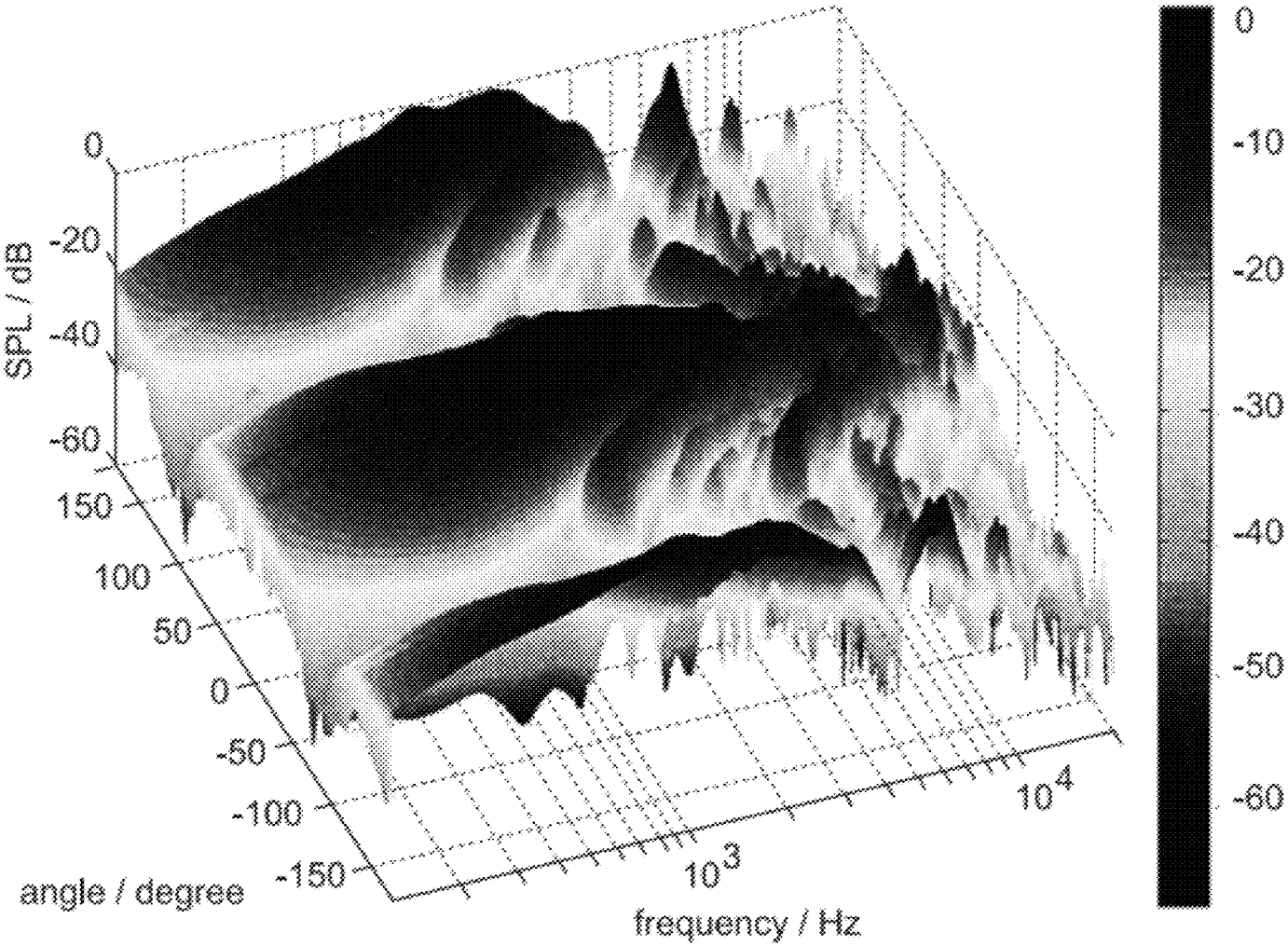
FIG. 5 measured front lobe directivity pattern of the uncompensated 6-loudspeaker dipole panel.
Figure 6:
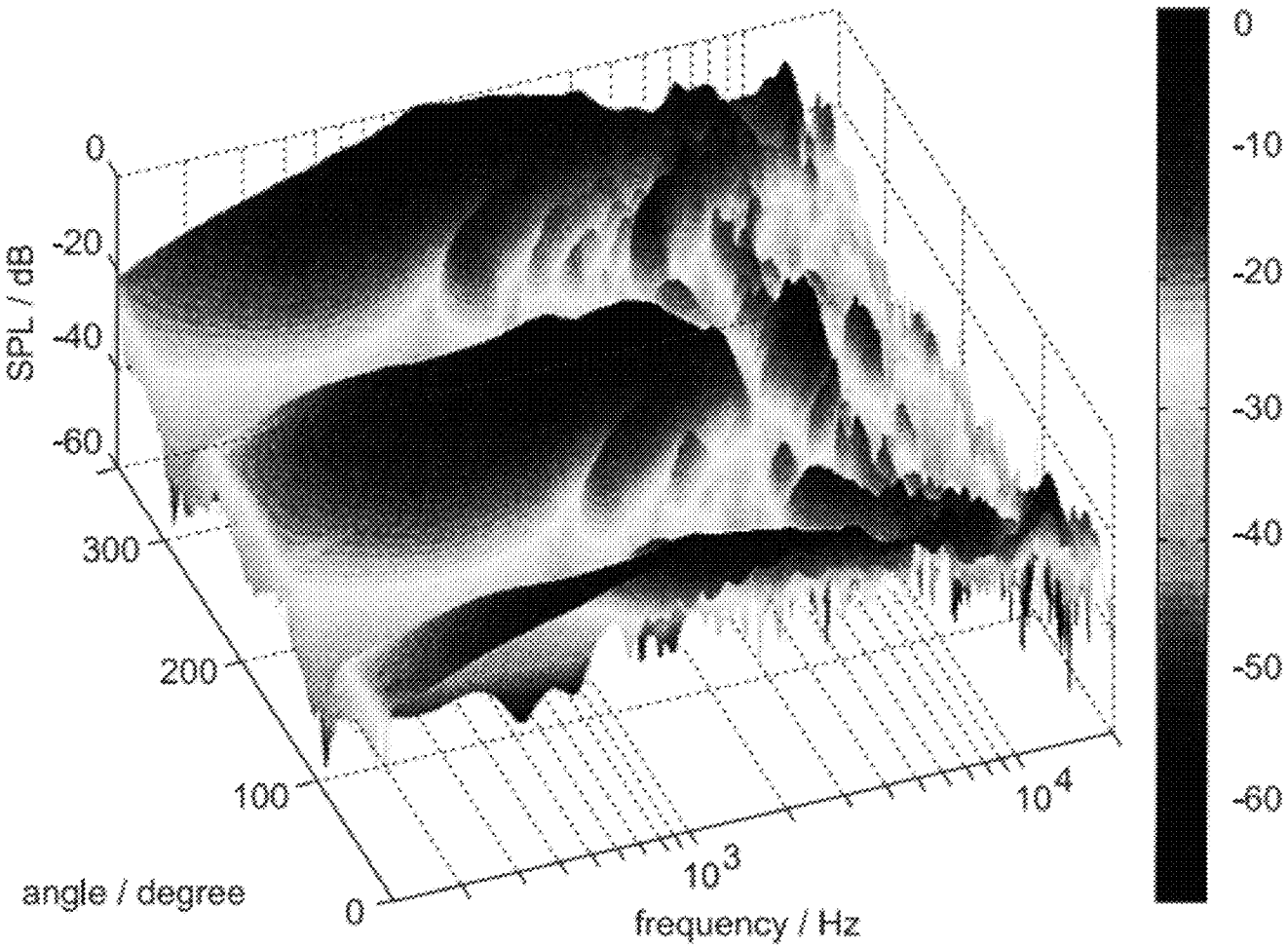
FIG. 6 measured back lobe directivity pattern of the uncompensated 6-loudspeaker dipole panel.

An element of the invention is dipole loudspeaker technology, in which a 6-loudspeaker dipole panel as depicted in FIG. 2 has been simulated and a prototype has been built and measured (one of the six loudspeakers 1 is not depicted). The six loudspeaker fronts are arranged in the x-y plane along the x axis within a common cabinet or housing 2. The interesting feature of such panel is its directional behavior, which is illustrated in FIG. 5 and FIG. 6 for an uncompensated panel and wherein the angle is related to the z-axis in FIG. 2. The corresponding frequency response of the 6-loudspeaker dipole panel as measured on the z-axis (0°) is shown in FIG. 3 with a bold line, and the 90 and 180 degree responses are show with the upper and lower thin lines, respectively.

Figure 4:
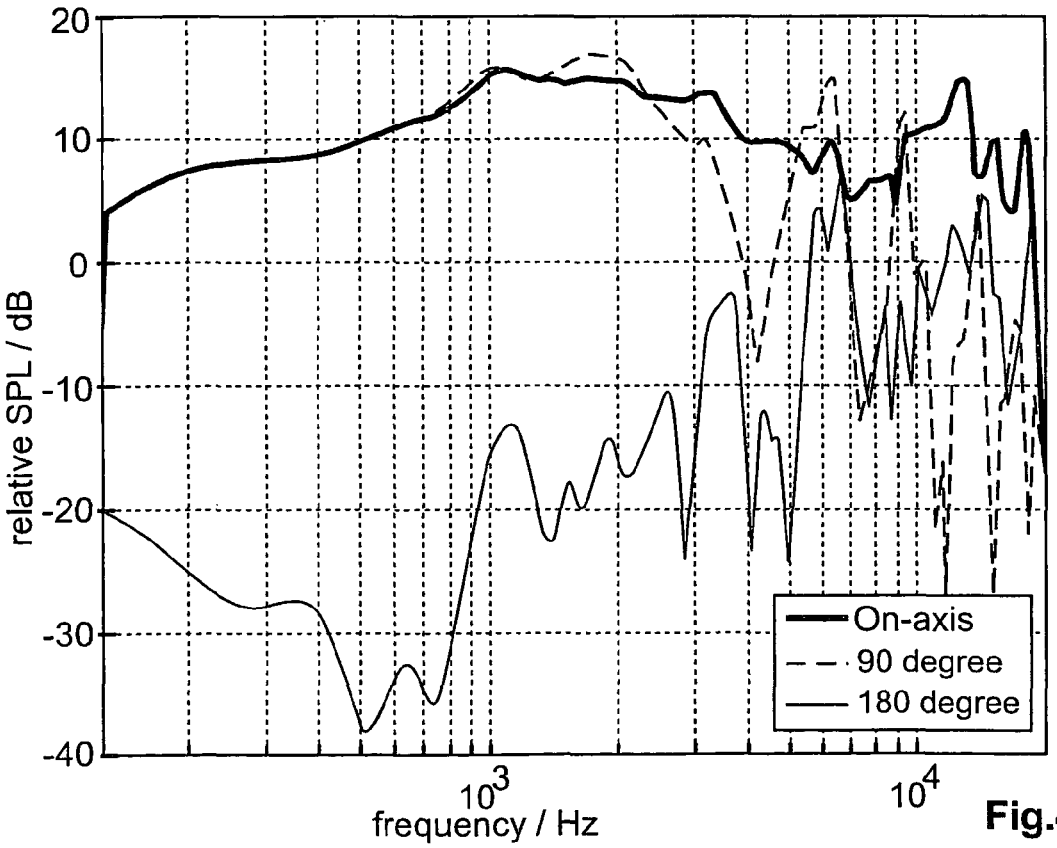
FIG. 4 compensated frequency response of the 6-loudspeaker dipole panel.
Figure 7:
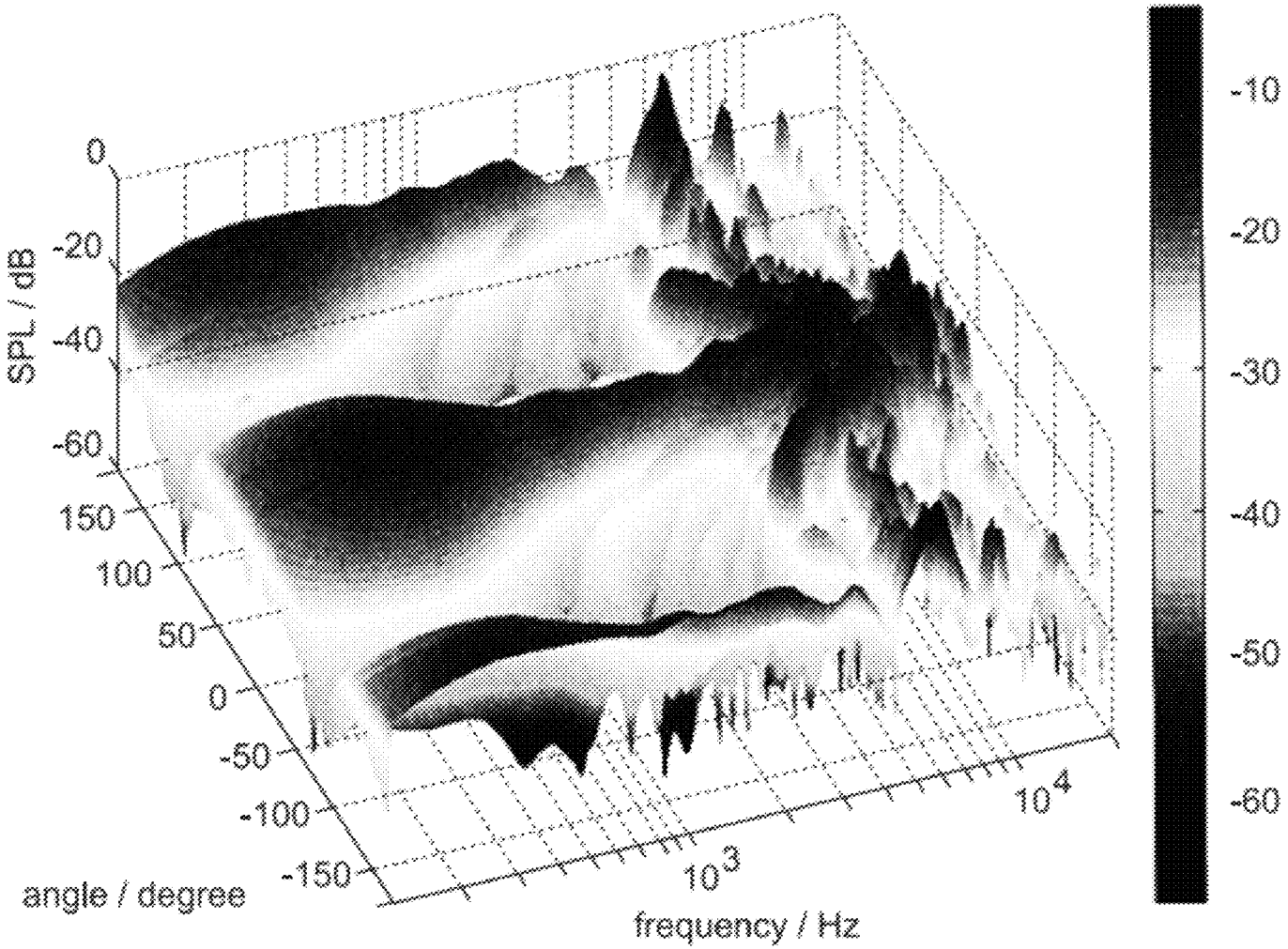
FIG. 7 measured front lobe directivity pattern for a corrected transfer function of the 6-loudspeaker dipole panel.
Figure 8:
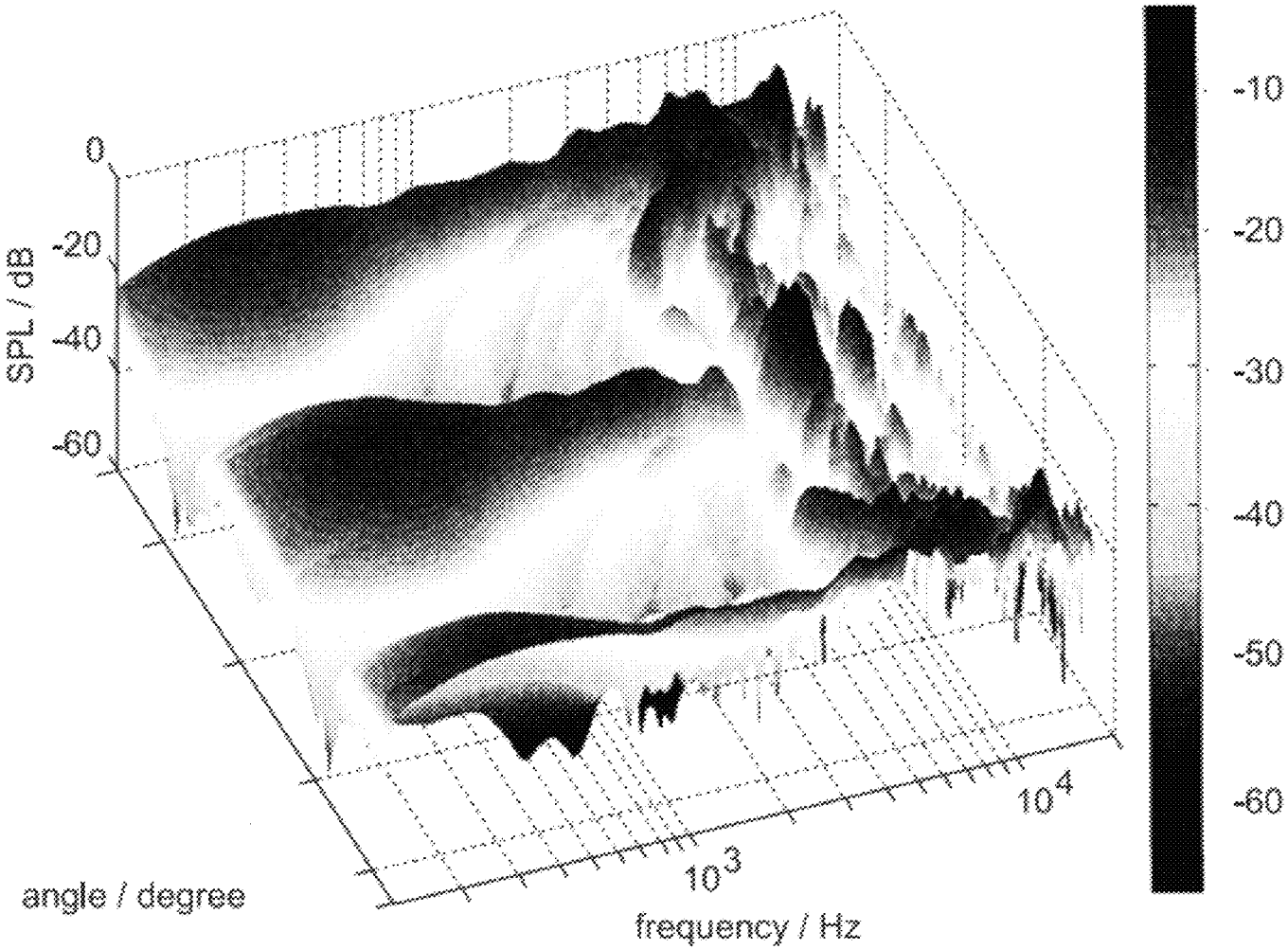
FIG. 8 measured back lobe directivity pattern for a corrected transfer function of the 6-loudspeaker dipole panel.

However, a compensation is desirable due to the typical dipole −6 dB/octave behavior below the panel's cut-off frequency. The corresponding compensation filter boosts higher and in particular lower frequencies. The corresponding compensated frequency response of the 6-loudspeaker dipole panel as measured on the z-axis (0°) is shown in FIG. 4 (the 90 and 180 degree responses are show with the upper and lower thin lines, respectively), and the corresponding directional diagrams are shown in FIG. 7 and FIG. 8.

For loudness adaptation technology, the most disturbing factor is the measurement of the signal coming directly from the panel, especially if the microphone is placed near the panel. Advantageously, if the microphone 3 is placed in the dipole panel plane (i.e. the x-y plane in FIG. 2), theoretically a complete cancellation of the sound pressure in an infinitely small volume element can be expected. But due to diffraction effects at the panel edges, reflections at the loudspeaker basket and asymmetries in the loudspeaker cone geometry, a finite cancellation only can be measured, as shown for the example panel in FIG. 4.

It is even more advantageous (cf. the below explanation) to place the microphone 3 in the x-y-plane with a little offset of 1-2 cm from the panel border, e.g. in the vertical middle (y=0), such that it is arranged in the homogenous region of the cancellation field.

The microphone's placement in z-direction is determined using support of measurement equipment, in order to find the minimum of the sound pressure level and to arrange the microphone at such location.

Figure 9:
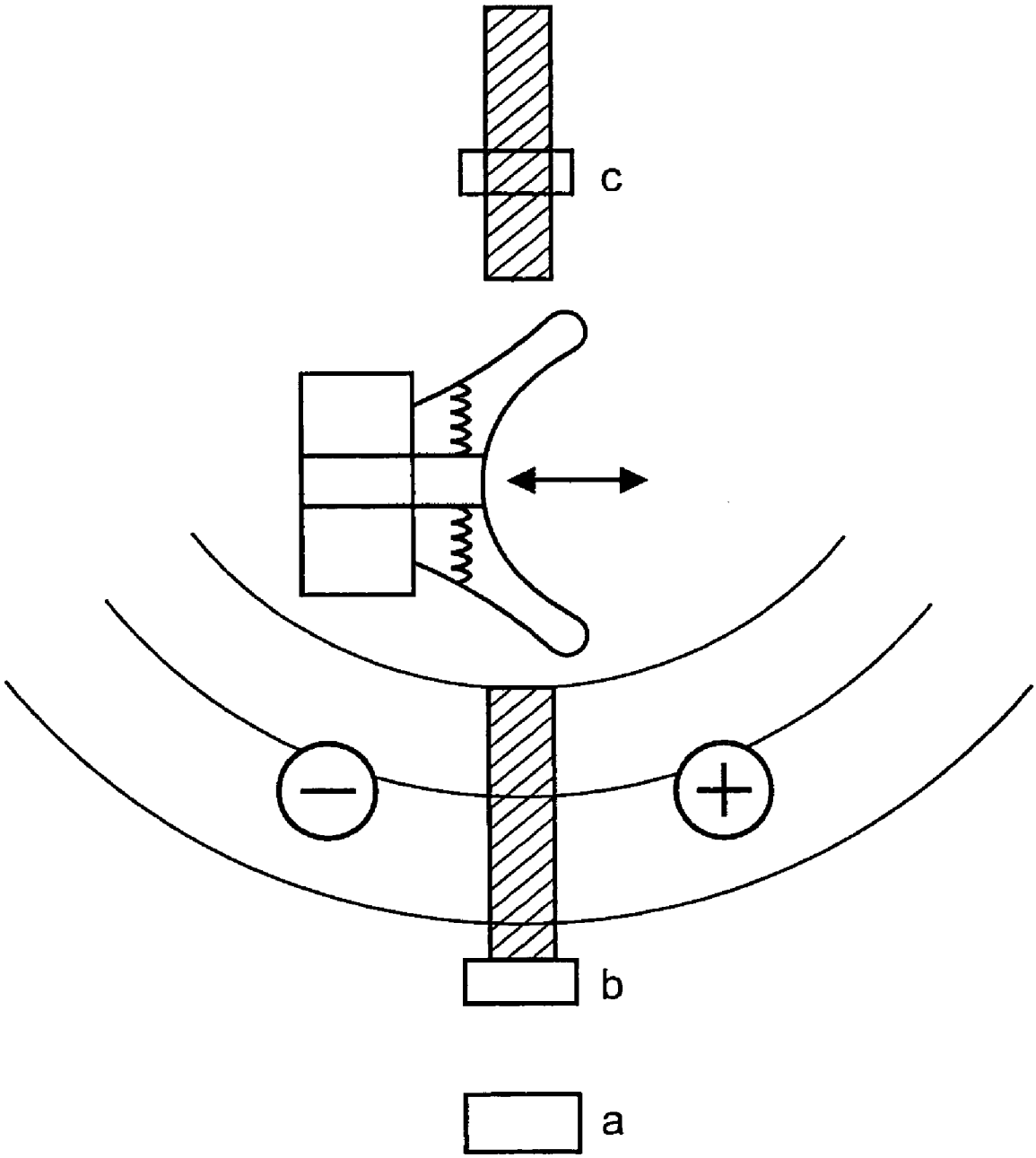
FIG. 9 three different microphone positions with respect to a loudspeaker.

As depicted in FIG. 9, when a diaphragm moves within the loudspeaker basket, the sound waves generated by the diaphragm spread with opposite polarity from the front and rear surfaces. Upon the sound waves arriving at the border of the baffle, they will cancel each other in the baffle plain. This effect is used to measure the background noise. For discussion about which positions and types of microphones are suitable, please refer to FIG. 9.

Microphone Position c:

Within the baffle, the sound pressure is as depicted (±) A pressure gradient receiver, e.g. a microphone, would produce no signal. It is not yet clear which other types of microphones could produce a useful signal.

Microphone Position b:

At the baffle edge, the sound field is just in the process of being established and the microphone would receive the alternating sound field as well as initial levels of the cancellation sound field. Further, strong diffraction effects are present so that the type of sound field (pressure or velocity field) can not be determined unambiguously. Therefore this microphone position should not be used.

Microphone Position a:

Beyond the baffle, the cancellation has occurred (no pressure, maximum velocity) and the sound field can be assumed to be homogenous. Therefore this position is suitable.

The microphone 3 captures basically the background noise. The microphone output signal is then used for controlling the gain of one or more amplifiers (not depicted) driving the loudspeakers 1 in order to control the sound pressure level output from the loudspeakers.

The measured microphone output signal can be spectrally filtered such that in a first frequency band $f_1$ (e.g. 500 Hz . . . 800 Hz in FIG. 4) the suppression of the panel output signal is at its maximum to achieve a measurement of the background noise only, and that in a second frequency band $f_2$ (e.g. 5.5 kHz-7 kHz in FIG. 4) the background noise and the loudspeaker panel signal are measured together for determining the loudspeaker panel's loudness. If the background noise level is known by measurement in band $f_1$, the presentation loudness level can be set based on the known amplification factor of the panel (i.e. a 'controlled characteristic').

In case the presentation loudness level is additionally measured in band $f_2$, a regulator can be constructed. In practice, frequently the presenter is not in operation because the workforce of the shop may damage loudspeakers which produce a loudness level that is too high. However, the $f_2$ signal represents a documentation feature that is of importance for the client of the advertisement because he will appreciate that the operation of the presenter can be tracked continuously.

In order to reduce the problem of determining the appropriate $f_1/f_2$ setting, temporal averaging can be used.

Due to the strong directional behavior of the panel (see FIG. 7), the influence of the reflected panel signal with respect to the background noise will be relative small, especially if a small difference (for example 6 dB) between the panel signal level and the background noise level is needed.

The measurement and the judgment of the signals can be carried out using known techniques like RMS calculation or time judgment for controlling the loudspeaker panel's volume.

An exemplary application of the invention is to adjust the loudness of an audio presentation device with a constant level above a time varying background noise level for supermarket advertisement or for audio information systems in exhibitions. The invention reduces the required processing power for such controlled public audio information systems.

Optionally, on one hand the measurement and calculations can be frequency dependent in order to still improve the processing such that using an additional echo-cancellation processing can be avoided. On the other hand, the robustness of echo cancellation processing can be improved when using the invention.

The invention can also be used in teleconferencing systems.

What is claimed is:

1. A loudspeaker panel with a common open housing including several loudspeakers arranged in a plane such that the loudspeaker panel forms a dipole having a directional sound pressure characteristic, wherein an axis of symmetry of each loudspeaker is arranged in z-direction perpendicular to said plane and wherein to said housing a single microphone is attached outside said housing and on said plane.

2. The loudspeaker panel according to claim 1, wherein said microphone is attached shifted in said z-direction such that said microphone receives a minimum sound pressure level from a direct sound emitted from said loudspeakers.

3. The loudspeaker panel according to claim 1, wherein said microphone is attached outside said housing with a distance of 1-2 cm.

4. A method for using a loudspeaker panel for audio presentation, said loudspeaker panel having a common open housing including several loudspeakers arranged in a plane such that the loudspeaker panel forms a dipole having a directional sound pressure characteristic, wherein an axis of symmetry of each loudspeaker is arranged in z-direction perpendicular to said plane and wherein to said housing a single microphone is attached outside said housing, said method comprising:

capturing background noise with said microphone;

capturing a loudspeaker signal with said microphone;

using a microphone output signal for controlling a sound pressure level output from said loudspeakers.

5. The method according to claim 4, wherein a signal driving said loudspeakers is frequency compensated.

6. The method according to claim 4, wherein an output signal of said microphone is spectrally filtered such that in a first frequency band a suppression of a loudspeaker panel output signal is at its maximum, and that in a second frequency band the background noise and the loudspeaker panel output signal are measured together for determining the loudspeaker panel's loudness.

7. The method according to claim 4, wherein a loudness of the loudspeaker panel is adjusted to a constant level above a level of said background noise.

8. The method of claim 4, further comprising presenting audio for supermarket advertisement or for audio information systems in exhibitions.

9. The method of claim 4, further comprising documenting over time the sound pressure level output from said loudspeakers.

10. The method of claim 4, further comprising presenting audio for determining defects in said loudspeaker panel.

* * * * *